US007172317B2

(12) United States Patent
Geens et al.

(10) Patent No.: US 7,172,317 B2
(45) Date of Patent: Feb. 6, 2007

(54) REFLECTOR LAMP

(75) Inventors: Rudy Geens, Heusden-Zolder (BE); Lode Derhaeg, Diest (BE); Marc van den Broeck, Linter (BE)

(73) Assignee: SLI Lichtsysteme GmbH, Erlangen (DE)

( * ) Notice: Subject to any disclaimer, the term of this patent is extended or adjusted under 35 U.S.C. 154(b) by 211 days.

(21) Appl. No.: 10/676,762

(22) Filed: Oct. 1, 2003

(65) Prior Publication Data

US 2005/0073847 A1 Apr. 7, 2005

(51) Int. Cl.
*F21V 7/00* (2006.01)

(52) U.S. Cl. ..... 362/296; 362/264; 362/307; 362/328

(58) Field of Classification Search ..... 362/296, 362/294, 307, 310, 264, 328; 313/25, 113, 313/573, 623
See application file for complete search history.

(56) References Cited

U.S. PATENT DOCUMENTS 4,939,408 A 7/1990 Gibson, III
4,961,019 A 10/1990 White et al.
6,002,197 A 12/1999 Tanaka et al.
6,600,256 B2 * 7/2003 Van Lier et al. ..... 313/313

FOREIGN PATENT DOCUMENTS

| | | |
|---|---|---|
| DE | 22 19 927 | 11/1972 |
| DE | 2245 071 | 3/1973 |
| DE | 39 04 927 C2 | 8/1989 |
| DE | 198 19 770 A1 | 11/1998 |
| DE | 102 33 073 B3 | 2/2004 |
| EP | 0 363 991 B1 | 4/1990 |
| EP | 0 560 936 B1 | 9/1993 |
| EP | 0902458 A2 | 3/1999 |
| WO | WO 92/10848 | 6/1992 |
| WO | WO 96/27205 A1 | 9/1996 |
| WO | WO 000/75957 A1 | 12/2000 |

* cited by examiner

*Primary Examiner*—John Anthony Ward
*Assistant Examiner*—Mark Tsidulko
(74) *Attorney, Agent, or Firm*—Brooks Kushman P.C.

(57) ABSTRACT

A reflector lamp which is structurally compact in its axial direction has a light capsule surrounded by a tubular shield with electric leads which are anchored or fixed in a base at one end of the lamp with the leads structurally arranged to support opposite ends of the light capsule and urge the shield against a wall through which the leads extend adjacent said base.

12 Claims, 5 Drawing Sheets

REFLECTOR LAMP

FIELD OF INVENTION

This invention relates to a reflector lamp, particularly to a metal halide reflector lamp.

BACKGROUND OF THE INVENTION

In European Patent EP 0 902 458 A2 a metal halide reflector lamp is shown comprising an outer envelope formed as a reflector with a neck portion and a base. A light transmitting cover in the form of a lens is connected along its circumference to an outer edge of the reflector, whereby reflector, base and cover are shaped generally rotationally symmetrical around a longitudinal axis. A light capsule or an arc tube, resp., having pinch seals at its ends and being surrounded by a shield formed as a tubular envelope and being arranged in the reflector within the shield by means of a first and a second electric lead. The first lead is at a first end of the capsule adjacent the base, and the second lead is installed on the outside of the shield and is introduced into the other end of the shield opposite the cover adjacent the second end of the capsule with both leads being sealed in the pinch seal adjacent the base. The reflector lamp shown in EP 0 902 458 A2 has a melting-in of the tubular envelope of the shield in the base area such that the two leads emerging from the base area are sealed into this pinch seal-like melting-in from which they exit in order to enter into pinch seals at opposite ends of the capsule. The shield thereby provides a so-called burst protection which protects the environment as against shards of a capsule which could explode possibly sometimes.

This known shield closed all around can be filled with a protective gas like nitrogen in order to protect from oxidation, at temperatures above 400 degrees Celsius, the welding between the respective lead-in and the respective sealed-in foil made from molybdenum which is necessary when quartz is used fox the capsule. It is known that sealings of lead-ins within quartz glass are not gas-tight because the thermal expansion coefficients are too different. The known shield as such, however, does not need any foils melted in because aluminum silicate glass is used for the shield, the thermal expansion coefficient of which corresponds essentially to that of the material of the lead-ins.

Even if this known structure is relatively compact already, the presence of a melt-in of the leads into the pinch seal-like end of the shield opposite the base and the use of protective gas constitutes a remarkable manufactural-technical expenditure on the one hand, on the other hand such melt-in makes the shield longer and by this enlarges the reflector lamp in the direction of its longitudinal axis.

With the reflector lamp known from WO 96/27205 A1 the first as well as the second lead-in are installed within the shield and exit from the shield at the side of the base, whereby a sealing consisting of curable cement is present between the shield and the lead-ins which is to be regarded as an additional expenditure the same way as melt-in which is for granting a hermetic sealing of the shield.

Finally the EP 0 560 936 B1 teaches a reflector lamp with a cylindrical shield which is retained by special clips which at least partially grip around the circumference of the shield at its two ends. The clips form part of a separate maintenance structure for the shield which comprises a holding web between the two clips and a special holding ring for the holding web in the base area of the lamp. This complicated maintenance structure for the shield forms a special expenditure.

SUMMARY OF INVENTION

In view of this the object underling the invention is seen in the provision of a reflector lamp of this kind which can be manufactured with remarkably lesser expenditure and which, beyond that, is structurally more compact, i.e., is shorter in the direction of its longitudinal or rotational, resp., axis.

This object is solved in accordance with the invention in that, eliminating melt-ins of the electric leads within the shield which seal the capsule as against the environment, the leads are fixed in the base only, and in that the second lead is biased such that, by this second lead which abuts from the outside against the end of the shield adjacent the cover or lens, the shield is pressed against a bottom of the neck portion of the reflector, the leads being guided through openings in this bottom towards the base, which is secured to the bottom, and are fixed there.

To dispose of melt-ins or sealings, reasp., of the lead-ins in the shield which seal the capsule as against the environment, whereby the lead-ins are fixed in the base of the reflector lamp only, makes the reflector lamp in accordance with the invention shorter between base and cover or lens, reasp., and by this renders same more compact; in addition thereto it provides savings in manufacture expenditure. The fixation of the shield at the reflector being necessary anyway is accomplished by the inventive development of the second lead-in in that the second lead-in draws the shield to the bottom of the reflector and keeps it fixed to the bottom, the ring shaped abutment surface of the end of the shield present at the side of the base providing stability.

It is understood that this ring shaped abutment surface means no hermetic seal and that, therefore, the ambient air and by this oxygen have access to the interior of the shield and, hence, to the light capsule or arc tube, reap., and temperatures above 400 degrees Celsius may lead to oxidation of the welding between lead-in and sealed-in foil. This has negative effects and should be avoided, therefore. But in further development of the invention the temperature should be kept low in this area or the access of air and by this oxygen to this area should be prevented.

To avoid this several possibilities are offered according to the invention:

1.

A first heat protection which surrounds the end of the arc tube in the region of its pinch seal on the side of the base above the welded joint of lead-in and melted-in foil and which lies opposite the bottom of the reflector neck is provided with an opening for the passage of the second lead-in, this opening being aligned with the first passage opening in the bottom.

The heat protection prevents the temperature in the region of the welding between lead-in and melted-in foil from becoming so high that oxidation occurs.

Suitably the first heat protection on the side of the base is fixed by support in the neck region and on the side of the cover is fixed by the shield being drawn to such support by the second lead-in. Further, the second lead-in and the first heat protection are insulated from each other in the region of the opening.

Advantageously a second heat protection can also be provided which surrounds the end of the capsule on the side of the cover in the region of its pinch seal below the welding between second lead-in and melted-in foil and lies opposite the upper end of the shield on the inner side in order to achieve the same effects with regard to the end of the capsule on the side of the cover.

2.

Between the end of the arc tube on the side of the base and the shield on the one hand as well as between the shield and the neck of the reflector on the other hand cement can be inserted such that the lower region of the pinch seal end is covered by cement. By this a cooling effect is achieved which prevents the oxidation mentioned under 1, and in addition thereto the whole structure becomes more stabile thereby.

3.

The location at which the first lead-in enters the appertaining pinch seal of the first end of the capsule can be closed by glass solder. Advantageously also the location at which the second lead-in enters the appertaining pinch seal of the second end of the capsule can be closed with glass solder. Instead of glass solder sodium silicate glass can be used as well. By this any access of air and, therefore, oxygen is reliably prevented and an oxidation of the welding between lead-in and melted-in foil blocked.

Two further advantageous possibilities consist in either to platinize the lead-ins or to cover same with quartz glass, which in both cases prevents its oxidation.

BRIEF DESCRIPTION OF THE DRAWINGS

The invention and its advantageous developments are explained in more detail by the assistance of embodiments depicted in the drawings.

DETAILED DESCRIPTION

Figure 1:
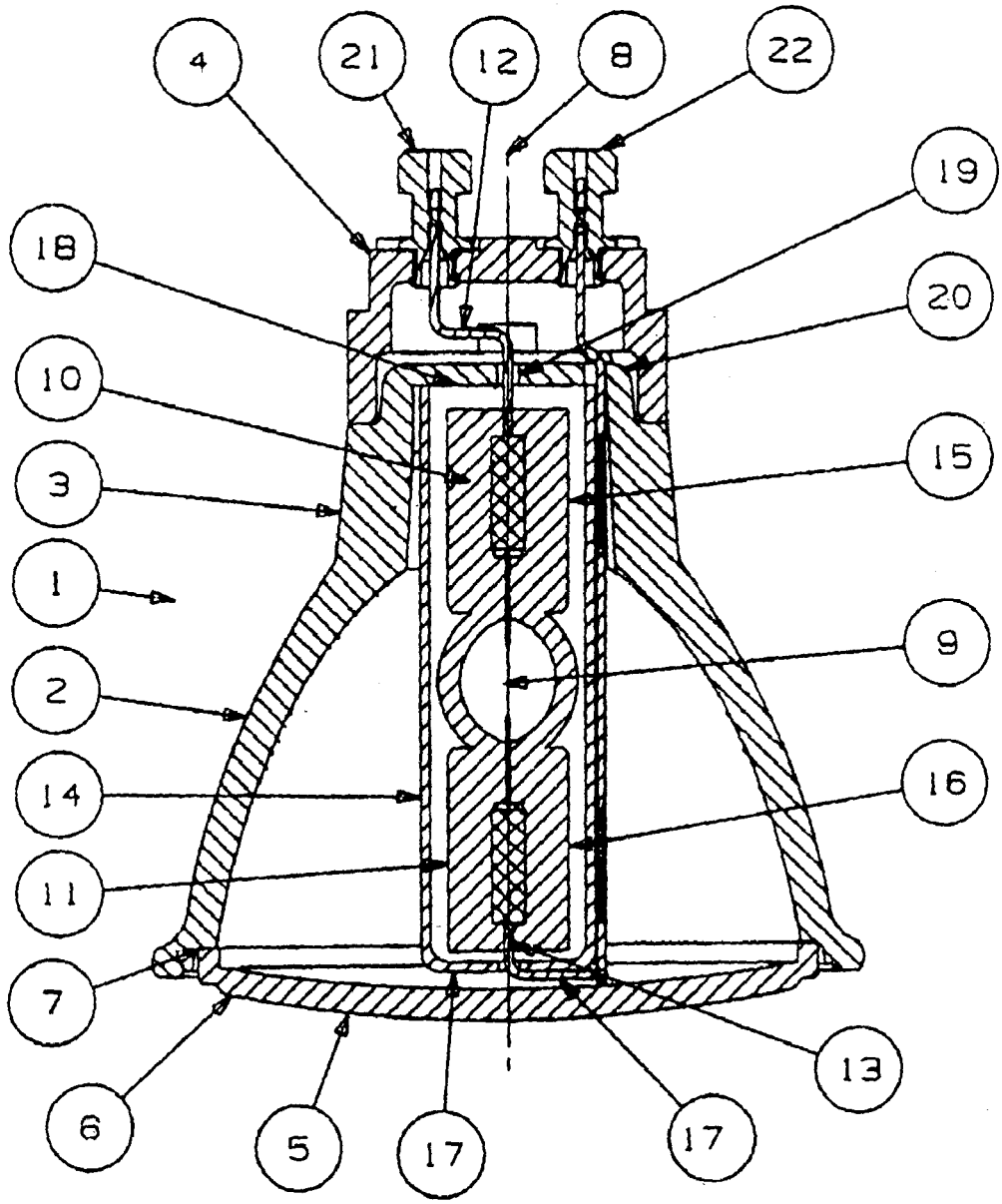
FIG. 1 is a cross section through a first embodiment of the invention.

FIG. 1 illustrates a first embodiment of a reflector lamp 1, particularly a meal halogen vapor reflector lamp, having an outer envelope formed as a reflector 2 with a neck region 3 having a base 4 fixed thereon and a light transmitting cover 5 comprising a lens which along its circumference 6 is connected to an outer edge 7 of the reflector 2.

Reflector 2, base 4 and lens or cover 5 are formed essentially rotationally symmetrically around a longitudinal axis 8.

Between base 4 and lens 5 a light capsule or arc tube 9 having pinch seals 10 and 11 at its ends is arranged in the reflector 2 and is surrounded by a shield 14 in the shape of a tubular envelope. The shield can serve not only as a burst protection but can also consist of UV absorbent glass or can be coated with a UV absorbent layer in order to avoid an undesirable sodium loss. The arc tube 9 is held within the shield 14 by a first and by a second lead 12 and 13, the first lead 12 being sealed-in at the first arc tube end 15 near the base 4 and the second lead 13 being sealed-in at the second arc tube end 16 near the lens 5, each within pinch seals 10, 11. The arrangement of the arc tube 9 is done preferredly concentrically along the rotational or longitudinal, resp., axis 8.

The second lead 13 is installed on the outside of the shield 14 and is inserted in the end 17 of same adjacent the lens 5.

In accordance with the invention, eliminating melt-ins of the leads 12, 13 within the shield 14 which seal the light capsule or arc tube 9 against the environment, the leads 12, 13 are fixed the base 4 only. Further, the second lead 13 is biased such that, by this second lead 13 which abuts from the outside at 17' against the end 17 of the shield 14 adjacent the lens 5, the shield 14 is pressed against the bottom 18 of the neck portion 3 of the reflector 2, the lead 12, 13 being guided through openings 19, 20 in this bottom 18 towards the base 4, which is secured to the bottom 18, and are secured there or mechanically fixed, resp. The ends of the leads 12 and 13 are electrically connected with terminals 21 and 22 fixed within base 4.

In the further embodiments according to FIGS. 2 to 5 similar parts are designated by the same reference numerals.

Figure 2:
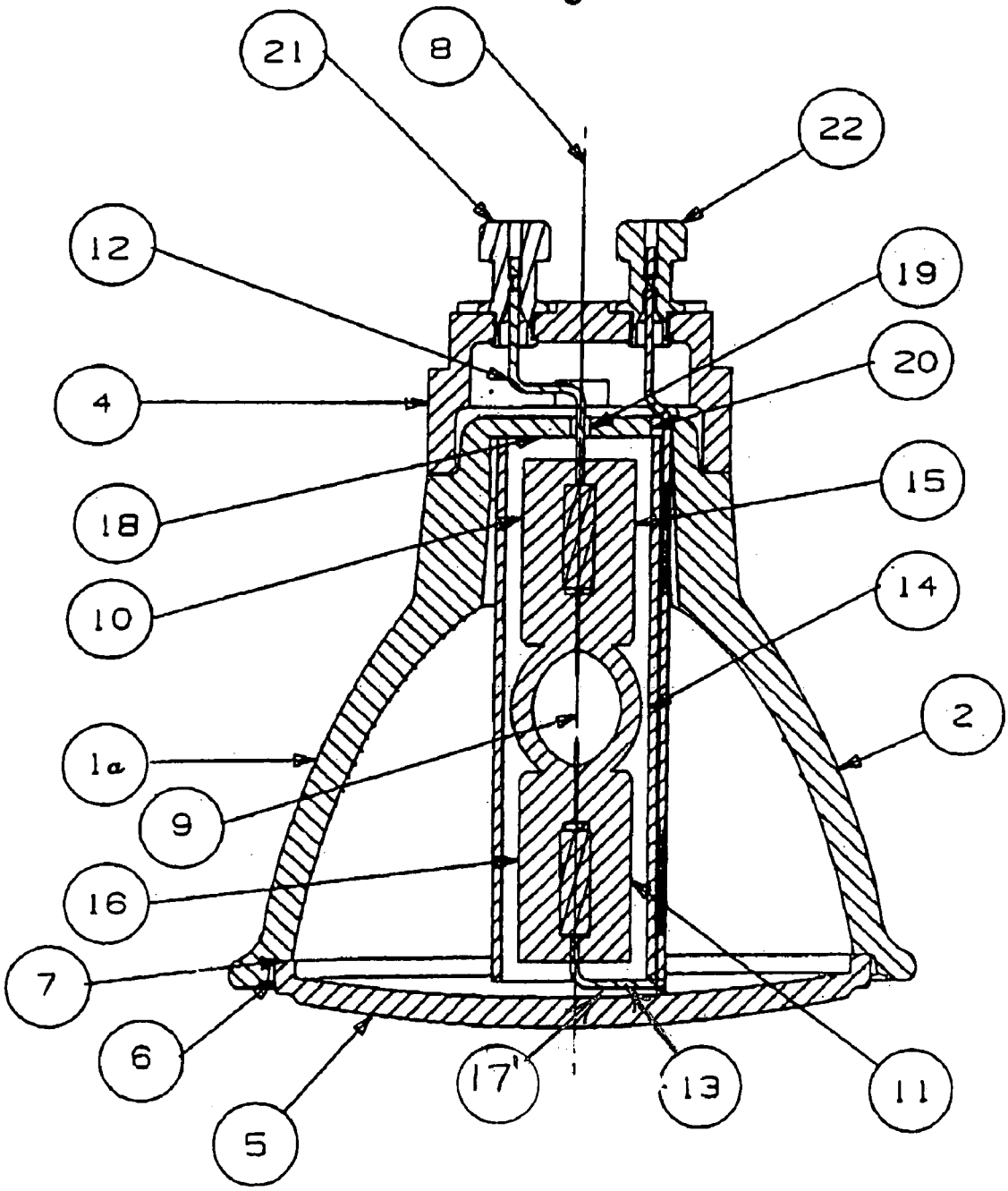
FIG. 2 is a cross section through a second embodiment.

The second embodiment of the reflector lamp 1*a* illustrated in FIG. 2 corresponds essentially to the first embodiment according to FIG. 1 with the exception of the fact that the shield 14 is open adjacent the lens 5 the same way it is adjacent the base, in other words, the shield is a cylinder open at both ends. Thereby the second lead-in 13 lies in the region 17' at the bottom edge of the shield 14 and presses same against bottom 18.

Figure 3:
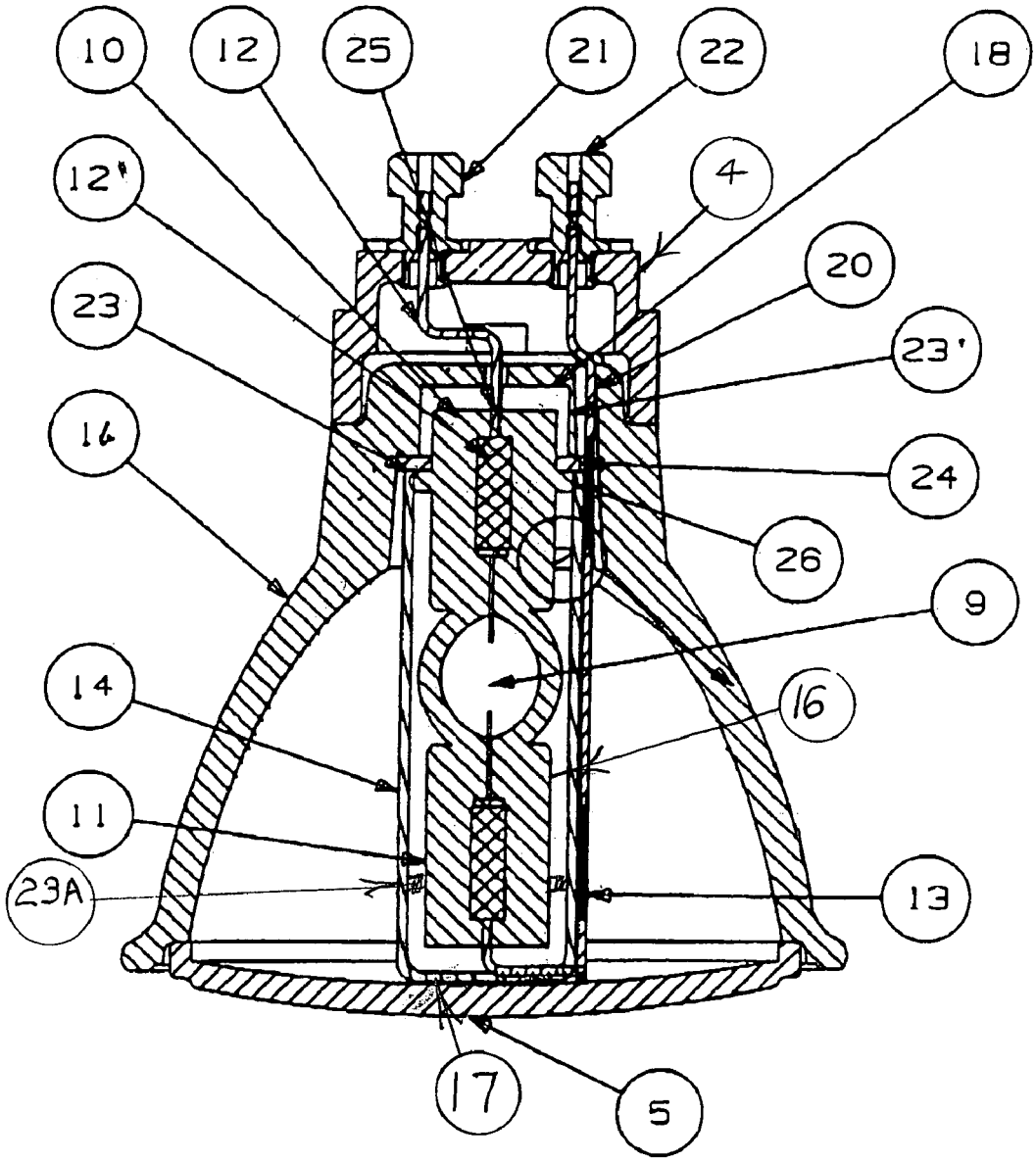
FIG. 3 is a cross section through a third embodiment.

With the third embodiment of the reflector lamp 1*b* illustrated in FIG. 3 a first heat protection 23 with a passage 24 for the second lead-in 13 is provided which surrounds the end 10 of the arc tube 9 at the side of the base in the region of its pinch seal above the welding between lead-in 12 and melted-in foil 12' and lies opposite bottom 18. This passage 24 is aligned with the respective passage 20 in bottom 18.

As to be taken from FIG. 3, this first heat protection 23 at the side of the base 4 is fixed by support 23' in the neck region 3 and at the side of the cover 5 by the shield 14 drawn to the bottom by the second lead-in 13.

Suitably the second lead-in 13 and the first heat protection 23 are insulated from each other in the area of the passage 24.

The heat protection 23 protects the area of the pinch seal in which the welding between lead-in and melted-in foil 12' is to be found, as against the heat which is emitted from the arc tube 9.

Besides, in FIG. 3 a suitable extension on both sides 26 of the pinch seal end 10 is shown which effects a positioning of the arc tube 9 at the heat protection 23.

Suitably a second heat protection 23A can be provided which surrounds the end 16 of the arc tube 9 at the side of the cover 5 in the region of its pinch seal 11 above the welding between lead-in and melted-in foil and lies opposite to the lower end 17 of shield 14 interiorly.

Figure 4:
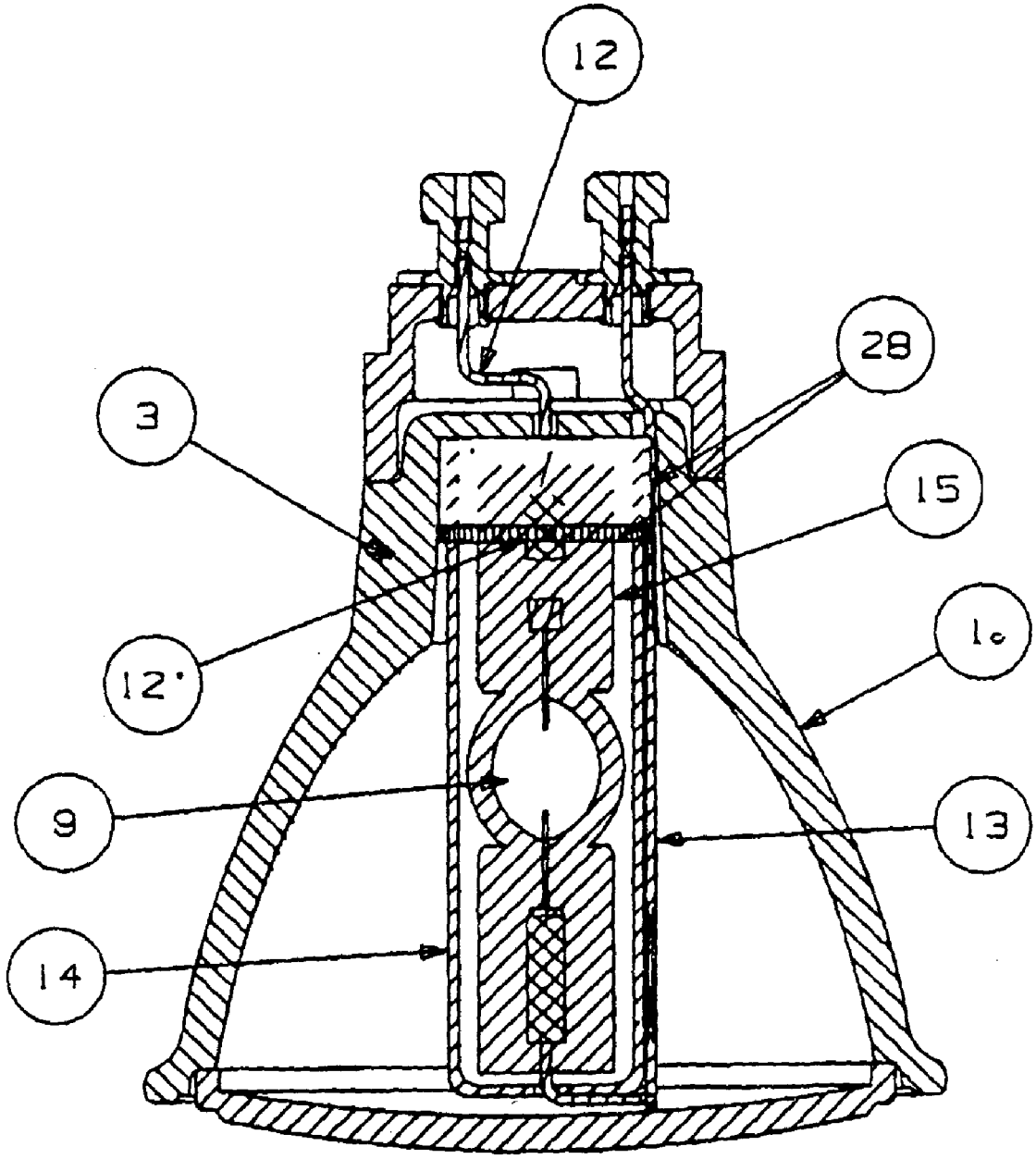
FIG. 4 is a cross section through a fourth embodiment.

With the fourth embodiment of the reflector lamp 1*c* illustrated in FIG. 4, between the first end 15 of the arc tube 9 at the side of the base and the shield 14 on the one hand as well as also between the shield 14 and the reflector neck 3 on the other hand, cement 28 is inserted such that firstly a cooling effect is achieved which prevents an oxidation of the welding between lead 12 and melted-in foil, and secondly the whole structure becomes more stable.

Figure 5:
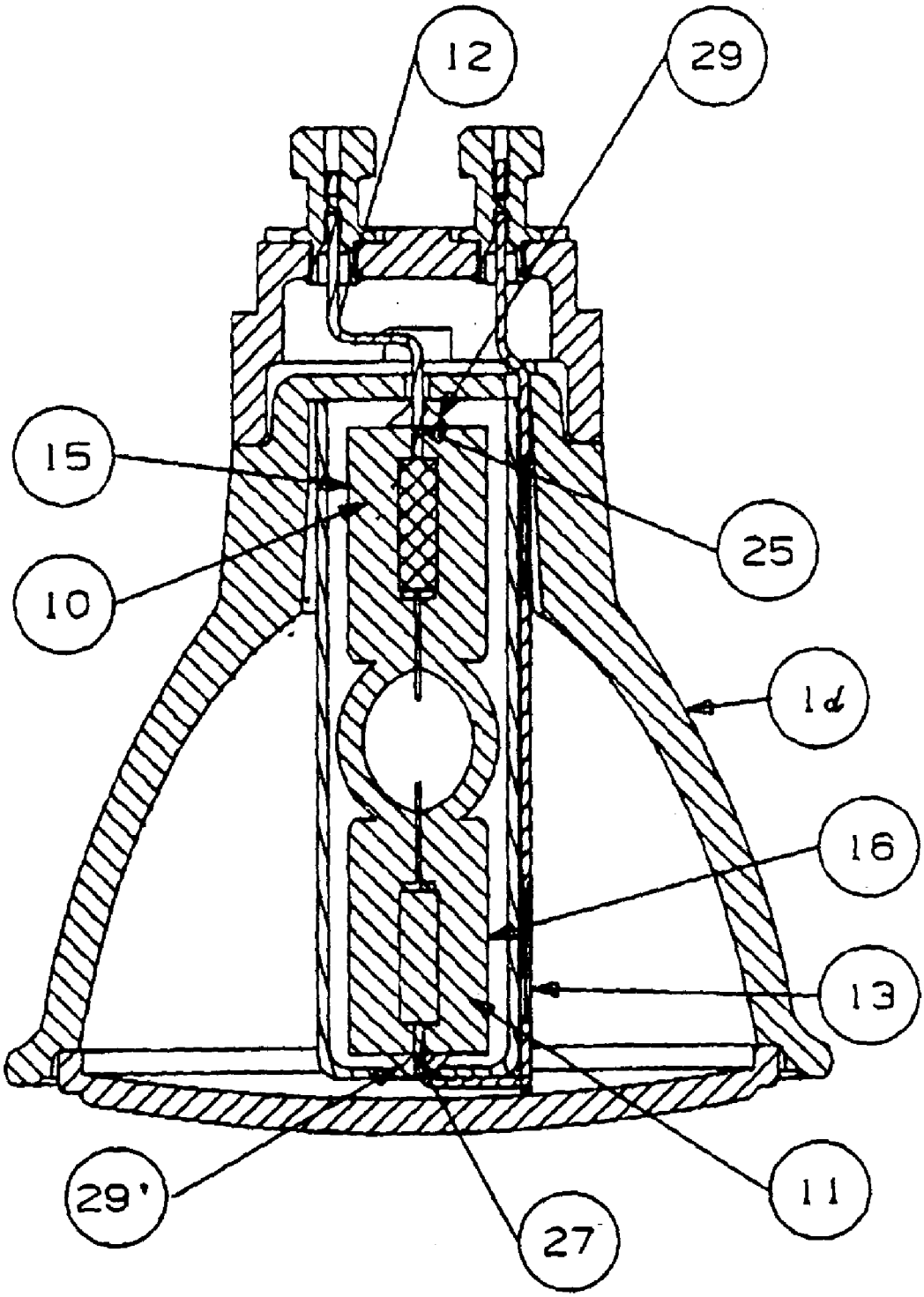
FIG. 5 is a cross section through a fifth embodiment.

With the fifth embodiment of the reflector lamp 1*d* illustrated in FIG. 5 the location 25 at which the first lead-in 12 enters into the appertaining pinch seal 10 of the first end 15 of the arc tube 9 is closed by glass solder 29.

Suitably also the location 27 at which the second lead-in 13 enters into the appertaining pinch seal 11 of the second end 16 of the arc tube 9 is closed by glass solder 29'. Instead of glass solder 29 and 29' sodium silicate glass can be used as well.

In a manner not shown the lead-ins 12, 13 can optionally be platinized or covered with quartz glass, which is not demonstrated in detail. Also in a manner not shown the lead-in 13 can be electrically insulated in the region of the pinch seals 10 and 11, e.g. by a ceramic sleeve.

The invention claimed is:

1. A reflector lamp comprising, in combination:

an outer envelope formed as a reflector with a neck portion at one end and a light transmitting cover or lens at the opposite end, said neck portion having a bottom wall facing the lens at the opposite end of the envelope, a base fixed on the neck portion overlying said bottom wall, said reflector, base and neck portion shaped generally rotationally symmetrically around a longitudinal axis;

a light capsule disposed within the envelope between, the lens and said bottom wall, a light transmitting tubular shield within the envelope surrounding the capsule and extending from adjacent the lens to said bottom wall, first and second electrical leads fixed in said base and extending through said bottom wall, said first lead electrically connected to the end of the capsule adjacent said bottom wall and said second lead electrically connected to the end of the capsule adjacent the lens with said first and second leads cooperatively supporting the capsule within the shield, said second lead shaped and proportioned to engage the shield adjacent the lens and urge the shield against said bottom wall of the neck portion, and said shield being open at the end adjacent said lens and said second lead extending through such open end of the shield and bearing against such end urging the shield against said bottom wall.

2. The reflector lamp of claim 1 wherein said bottom wall is provided with a pair of through apertures for receiving said leads fixed in and coming from said base with one aperture opening within the shield toward the capsule and the other aperture opening outside said shield toward said lens.

3. The reflector lamp of claim 2 wherein the leads are moveably received in said apertures.

4. The reflector lamp of claim 3 wherein a heat barrier encircles the capsule adjacent said neck portion and extends between the capsule and the surrounding shield for reducing the heat transmission from the light capsule to the electrical connection between the said first lead and said light capsule.

5. The reflector lamp according to claim 4 wherein a second heat barrier encircles the capsule adjacent the lens and extends between the capsule and the surrounding shield for reducing the heat transmission from the light capsule to the electrical connection between the second lead and said light capsule.

6. The reflector lamp of claim 2 wherein said heat barrier is provided with a through aperture aligned with said other aperture for moveably receiving there through said second lead.

7. The reflector lamp of claim 6 wherein the end of the shield adjacent said neck portion is urged against said heat barrier by said second lead.

8. The reflector lamp of claim 6 wherein said second lead is heat insulated from said heat barrier where said second lead extends through said through aperture in the heat barrier.

9. The reflector lamp of claim 1 wherein cement is provided between the bottom wall of the neck portion and the adjacent end of the light capsule and between the adjacent end of the tubular shield and interior of the neck portion thereby reducing the temperature at the connection between the first said lead and the light capsule and improving stability of the tubular shield and the light capsule.

10. The reflector lamp of claim 1 wherein said first lead enters said light capsule at the end thereof adjacent said bottom wall and is electrically connected to the light capsule, and glass solder or sodium silicate surrounds said lead where it enters the light capsule.

11. The reflector lamp of claim 1 wherein said second lead enters said light capsule adjacent the lens and is electrically connected to the light capsule, and glass solder or sodium silicate surrounds said lead where it enters the light capsule.

12. A reflector lamp according to any preceding claim wherein the leads are covered with quartz glass.

* * * * *